US012319459B2

(12) United States Patent
Loperfido et al.

(10) Patent No.: US 12,319,459 B2
(45) Date of Patent: Jun. 3, 2025

(54) MACHINE FOR PACKAGING GROUPS OF TISSUE PRODUCTS AND METHOD FOR CHECKING THE CONFORMITY OF LAYERS OF GROUPS OF TISSUE PRODUCTS

(71) Applicant: T.M.C. S.P.A., Castel Guelfo (IT)

(72) Inventors: Gianfranco Loperfido, Lugo (IT); Roberto Ponti, Faenza (IT); William Rossi, San Giorgio di Piano (IT)

(73) Assignee: T.M.C. S.P.A., Castel Guelfo (IT)

( * ) Notice: Subject to any disclaimer, the term of this patent is extended or adjusted under 35 U.S.C. 154(b) by 49 days.

(21) Appl. No.: 18/009,251

(22) PCT Filed: Jun. 1, 2021

(86) PCT No.: PCT/IB2021/054801
§ 371 (c)(1),
(2) Date: Dec. 8, 2022

(87) PCT Pub. No.: WO2021/250506
PCT Pub. Date: Dec. 16, 2021

(65) Prior Publication Data

US 2023/0234740 A1 Jul. 27, 2023

(30) Foreign Application Priority Data

Jun. 11, 2020 (IT) ..... 102020000013987

(51) Int. Cl.
*B65B 57/14* (2006.01)
*B65B 11/02* (2006.01)
(Continued)

(52) U.S. Cl.
CPC ..... *B65B 57/14* (2013.01); *B65B 11/025* (2013.01); *B65B 25/146* (2013.01); *B65B 35/30* (2013.01); *B65B 35/405* (2013.01); *B65B 35/54* (2013.01)

(58) Field of Classification Search
CPC ..... B65B 57/14; B65B 11/025; B65B 35/30; B65B 35/405; B65B 35/54
(Continued)

(56) References Cited

U.S. PATENT DOCUMENTS 7,104,031 B2 * 9/2006 Baggot ..... B65B 63/02 53/550
2010/0230238 A1 * 9/2010 Giuliani ..... B65B 35/44 198/418.3

(Continued)

FOREIGN PATENT DOCUMENTS

EP 1041005 A1 10/2000

OTHER PUBLICATIONS

International Search Report and Written Opinion dated Aug. 12, 2021 from counterpart International Patent Application No. PCT/IB2021/054801.

*Primary Examiner* — Robert F Long
*Assistant Examiner* — Xavier A Madison
(74) *Attorney, Agent, or Firm* — SHUTTLEWORTH & INGERSOLL, PLC; Timothy J. Klima

(57) ABSTRACT

A machine for packaging groups of tissue products includes a dosing element with a plurality of passageways, each for receiving a row formed by a predetermined number of products for defining a layer of a group of products. A detection device associated with the dosing element detects a filling parameter relative to a number, dimension and/or orientation of the products occupying the passageways and generates a signal representing the filling parameter. A processing and control unit receives the signals representing the products and processes the signals to compare with signals relating to a reference layer for deriving an acceptance condition, wherein the layer is consistent with the reference layer and suitable for the packaging, or for eliminating the layer of products released from the dosing ele-
(Continued)

ment. A rejection system ejects the layer when it is in the eliminating condition.

14 Claims, 3 Drawing Sheets

(51) Int. Cl.

| | |
|---|---|
| ***B65B 25/14*** | (2006.01) |
| ***B65B 35/30*** | (2006.01) |
| ***B65B 35/40*** | (2006.01) |
| ***B65B 35/54*** | (2006.01) |

(58) Field of Classification Search
USPC ..... 53/443
See application file for complete search history.

(56) References Cited

U.S. PATENT DOCUMENTS

| | | | | |
|---|---|---|---|---|
| 2015/0375879 | A1* | 12/2015 | Overley | B65G 47/082 198/429 |
| 2018/0037353 | A1 | 2/2018 | Franzaroli | |
| 2020/0307839 | A1* | 10/2020 | Franzaroli | B65B 11/585 700/223 |

* cited by examiner

MACHINE FOR PACKAGING GROUPS OF TISSUE PRODUCTS AND METHOD FOR CHECKING THE CONFORMITY OF LAYERS OF GROUPS OF TISSUE PRODUCTS

This application is the National Phase of International Application PCT/IB2021/054801 filed Jun. 1, 2021 which designated the U.S.

This application claims priority to Italian Patent Application No. 102020000013987 filed Jun. 11, 2020, which application is incorporated by reference herein.

TECHNICAL FIELD

This invention relates to a machine for packaging groups of tissue products and thus finds particular use in the context of packaging lines for products such as, for example, kitchen paper, toilet paper and other similar products.

The invention also relates to a method for checking the conformity of layers of groups of tissue products.

BACKGROUND ART

As is known, packaging machines comprise a plurality of stations distributed along a product feed line.

In particular, the prior art machines comprise a station for feeding tissue products wherein the products are moved in succession and a sorting station wherein the products are divided into rows and/or layers on the basis of the format of the product being processed and on the basis of the size of the group of products to be obtained.

Normally, the sorting station of the prior art machines comprises a launching device equipped with a plurality of channels alongside each other wherein the tissue products are organised in rows formed by a predetermined number of suitably oriented products (usually having the axis of extension positioned horizontally).

The prior art machines also comprise a transport station wherein the rows consisting of a predetermined number of products, and therefore having a predetermined length, and the layers previously assembled in the launching device are made to slide to a packaging station where they are grouped together in packages and wrapped using a wrapping film.

To guarantee the conformity of the group of tissue products, it is necessary that the rolls, in the case of toilet paper or kitchen paper, or the packets, in the case of soft tissues or boxes, have the same dimensions and the same orientation. It is also necessary, if a group of layered tissue products is to be obtained, for all the layers to be made up of the same number of products. The number of products present in each layer must also conform to a predetermined number.

During the operation of the prior art machines, however, it is possible that the feed station provides the launching device with products of an incorrect type and/or length and/or diameter and/or orientation, such as, for example, rolls with lengths different from a preselected length, or which provides products having incorrect orientations, such as, for example, rolls having the axis of extension positioned vertically instead of horizontally, or with the axis of extension rotated at right angles to the feed direction of the rolls. Sometimes, it is also possible for the feed station to provide more or less rolls than a predetermined number.

In order to overcome this problem, control devices are known which are configured to monitor the positioning, the dimensions and the number of products present in the channels and to signal the presence of an error in such a way as to stop the machine and allow the operator, through manual intervention, to complete the layer by adding or removing the necessary products or by suitably orienting the products in such a way as to shape the layer to a desired layer.

A solution of these control devices configured to monitor the products present in the channels is disclosed in patent document US2018/0037353.

Disadvantageously, these control devices have several drawbacks linked to the precision of identifying any anomaly in the layer of products and the removal of the layer and/or the incorrect product.

In the prior art machines, once the control device has identified the error it sends a signal to a control unit which blocks the operation of the machine. In this situation, the machine stops and an operator intervenes to partly remove the launching device in such a way as to remove the incorrect product or add the missing product.

This operation is time-consuming and expensive since the machine remains stationary for long periods of time and is completely unproductive.

Sometimes, the error in the number and/or arrangement and/or size of the products is not detected by the detection device itself. In this situation, the machine creates groups of tissue products which do not conform with each other.

In some cases, when the incorrect layer reaches the packaging station it causes jamming and blockages of the wrapping film around the layer. This situation is particularly disadvantageous since the incorrect products wrapped in the wrapping film can completely or partly block the station, creating mechanical stresses on some components which can thus be damaged.

This therefore results in an increase in costs and maintenance times, making the entire machine not very efficient and not in line with the production rates required by the market.

DISCLOSURE OF THE INVENTION

The technical purpose of the invention is therefore to provide a machine for packaging groups of tissue products and a method for checking the conformity of layers of a group of products which are able to overcome the drawbacks of the prior art.

The aim of the invention is therefore to provide a machine for packaging groups of tissue products which is reliable and precise.

A further aim of the invention is to provide a machine for packaging groups of tissue products which allows the layer of products containing an error to be removed automatically and without the need to perform a machine stoppage.

A further aim of the invention is to provide a method for checking the conformity of layers of a group of tissue products which allows a precise and reliable control to be performed.

The technical purpose indicated and the aims specified are substantially achieved by a machine and a method comprising the technical features described in one or more of the accompanying claims. The dependent claims correspond to possible embodiments of the invention.

In particular, the aims specified are substantially achieved by a machine for packaging groups of tissue products comprising a feed station comprising feed means configured for transporting a succession of tissue products along a feed direction and a management station positioned downstream of the feed station. The management station comprises, in accordance with the invention, a dosing element equipped with a plurality of passageways alongside each other and extending parallel to the feed direction in such a way as to each receive a row formed by a predetermined number of tissue products to define a layer of a group of tissue products, the passageways also being configured to release the layer. The management station also comprises, in accordance with the invention, a loop conveyor equipped with a plurality of crosspieces configured for pushing forwards along the feed direction each layer released by the dosing element. The machine according to the invention also comprises a packaging station positioned downstream of the management station and configured for receiving each layer coming from the loop conveyor. The packaging station comprises a packaging unit configured for wrapping a wrapper around each layer of tissue products. The machine according to the invention is characterised in that it also comprises at least one detection device associated with the dosing element and configured for detecting at least one filling parameter relative to a number and/or a dimension and/or an orientation of the tissue products occupying the passageways and to generate a signal representing at least one filling parameter. The machine according to the invention is characterised in that it also comprises a processing and control unit configured to receive the signals representing the tissue products and to process the signals in such a way as to compare them with signals relating to a reference layer for deriving an acceptance condition, wherein the layer is consistent with the reference layer and suitable for packaging in the packaging station, or for eliminating the layer of tissue products released by the dosing element. The machine according to the invention is characterised in that it also comprises a rejection system connected to the processing and control unit and which can be activated to eject the layer when it is in the eliminating condition.

Further features and advantages of the invention are more apparent in the non-limiting description which follows of a non-limiting embodiment of a machine for packaging groups of tissue products and a method for checking the conformity of layers of a group of tissue products.

BRIEF DESCRIPTION OF DRAWINGS

The description is set out below with reference to the accompanying drawings which are provided solely for purposes of illustration without restricting the scope of the invention and in which.

DETAILED DESCRIPTION OF PREFERRED EMBODIMENTS OF THE INVENTION

With reference to the accompanying drawings, the label "M" denotes a machine for packaging groups of tissue products "P" such as, for example, rolls of toilet paper, rolls of absorbent kitchen paper, tissues and the like. The accompanying drawings show rolls of toilet paper by way of non-limiting example.

The term "groups of tissue products" means packages of tissue products "P" having at least one layer "S" formed by a plurality of tissue products "P" positioned alongside each other.

Figure 1:
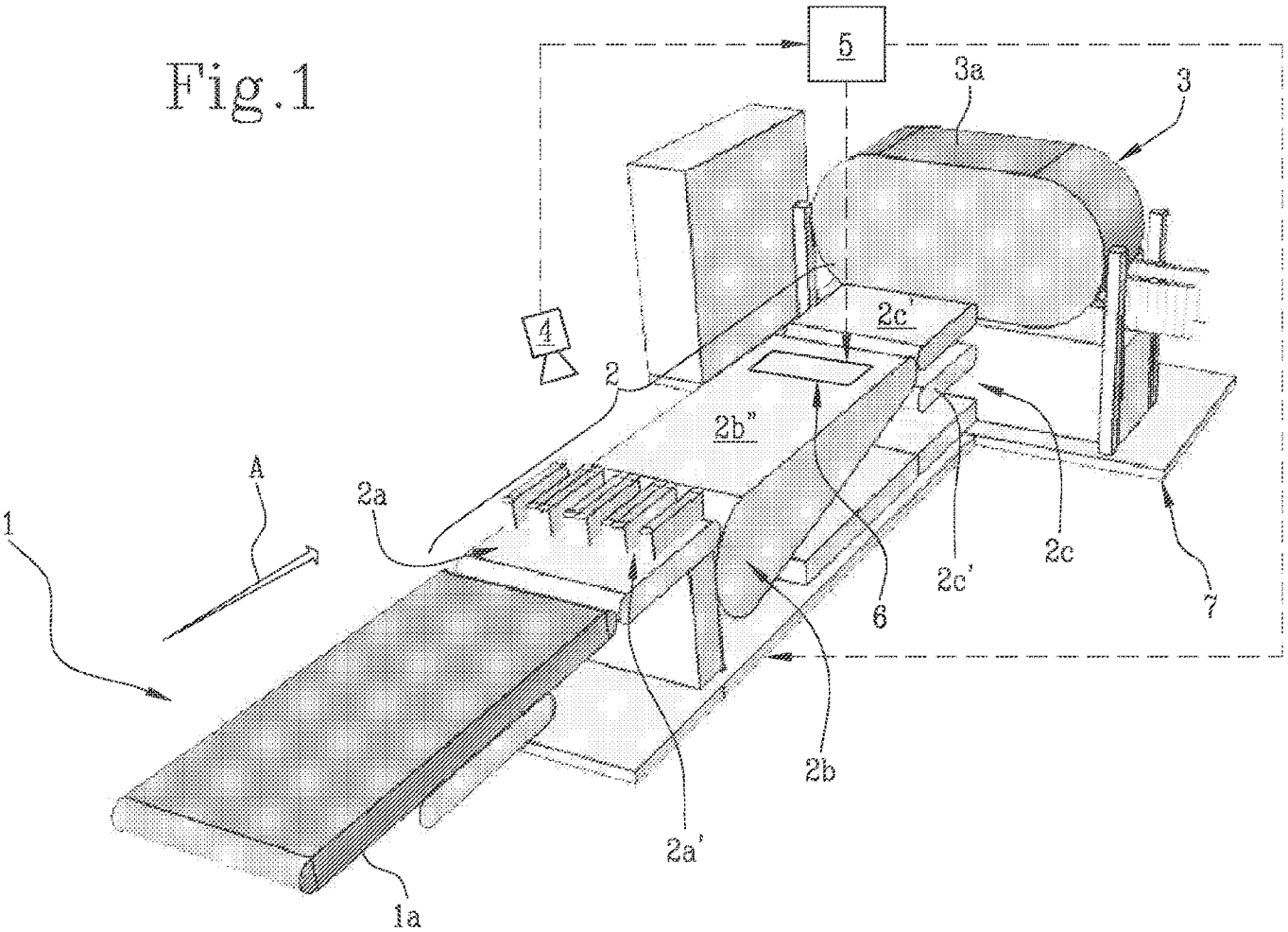
FIG. 1 shows a perspective view of the machine of the invention.

As shown in FIG. 1, the machine "M" comprises a feed station 1 in turn comprising feed means 1*a* configured for transporting a succession of tissue products "P" along a feed direction "A".

Preferably, the feed means 1*a* are made in the form of a conveyor belt. Even more preferably, the conveyor belt has partition walls (not illustrated) configured for maintaining a separation in rows of tissue products "P" during the feeding of the conveyor belt.

The machine "M" also comprises a management station 2 positioned downstream of the feed station 1 in such a way that the tissue products "P" can be divided and organised to form the layers "S" constituting the group of tissue products "P".

As shown in FIG. 1, the management station 2 comprises a dosing element 2*a* equipped with a plurality of passageways 2*a*' placed side by side and extending parallel to the feed direction "A". The passageways 2*a'* are each configured to receive a row "F" formed by a predetermined number of tissue products "P" to define a layer "S" of the group of tissue products "P" and to release the layer "S" formed in this way.

In use, the feed means 1*a* transfer the tissue products "P" to the dosing element 2*a* in such a way that the latter collects a number of tissue products "P" equal to the size of the layer "S" to be obtained to form the group of tissue products.

If, for example, the group of tissue products "P" to be obtained comprises layers "S" of twelve products "P" each, wherein the products "P" are divided into four rows "F", it is necessary that four passageways 2*a'* mutually side by side receive, respectively, three tissue products "P" each. Alternatively, if it is desired that a layer "S" always consists of twelve products "P" each, but wherein the products "P" are positioned in three rows "F", it is necessary that three passageways 2*a'* positioned alongside each other receive four tissue products "P" each.

Preferably, the tissue products "P" are cylindrical rolls and are fed to the passageways 2*a'* in such a way as to have the axis of extension positioned parallel to the feed direction "A", that is to say, positioned horizontally.

In a further possible embodiment, the tissue products "P" are packets having a substantially parallelepiped shape and are fed to the passageways 2*a'* in such a way that their axis of extension is also parallel to the feed direction "A".

Advantageously, the possibility of occupying a variable number of passageways 2*a'* with a different number of products "P" allows different sizes of layers "S" of tissue products "P" to be managed in such a way as to adapt to the production requirements.

Advantageously, the possibility of using the same passageways 2*a'* for tissue products "P" of different types and/or with different dimensions gives the machine "M" a high level of flexibility, allowing it to manage a wide range of types and sizes of tissue products "P".

Once the passageways 2*a'* of the dosing element 2*a* have been suitably occupied by the tissue products "P", the dosing element 2*a* releases the products "P", defining a layer "S", towards a loop conveyor 2*b*.

Figure 2:
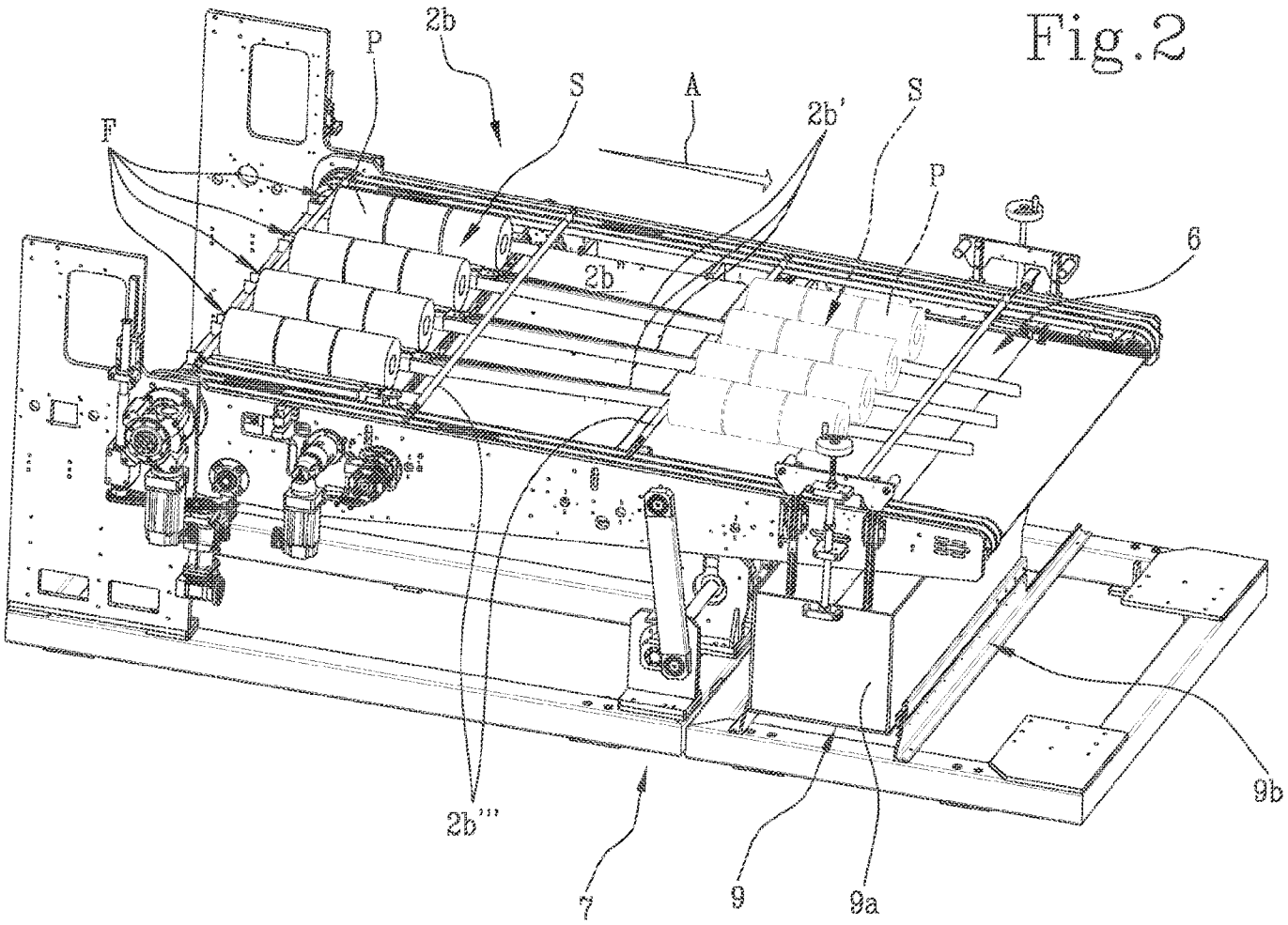
FIG. 2 is a perspective view of a component of the machine during its operation.

Preferably, as shown in FIG. 2, the loop conveyor 2*b* has a series of panels 2*b'* placed side by side in such a way as to define sliding channels for each row "F" of tissue products "P" released by the dosing element 2*a*.

Preferably, as shown in detail in FIG. 2, the channels extend along the feed direction "A" for guiding the rows "F" of tissue products "P" towards each other in such a way that, at the outlet from the loop conveyor 2*b*, the tissue products "P" of each row "F" are in contact with the respective tissue products "P" of the adjacent rows "F".

More in detail, as shown in FIG. 2, in an inlet section of the loop conveyor 2*b*, the channels are parallel to each other and spaced like the passageways 2*a'* of the dosing element 2*a* in such a way as to allow an easy entrance of the rows "F" of tissue products "P" released by the dosing element 2*a*.

In the accompanying drawings, the dosing element 2*a* releases four rows "F" from three tissue products "P" each of which are received in respective channels of the loop conveyor 2*b*.

Along the feed direction "A", the channels converge in such a way that in an outfeed section of the loop conveyor 2*b*, they convey the rows "F" of the layer "S" towards each other in such a way that they are side by side without there being empty spaces between one and the other.

In the example embodiment shown in the accompanying drawings, a layer "S" of tissue products "P" of the 4×3 type is obtained in the outlet section of the loop conveyor 2*b*.

To allow the feeding of the tissue products "P" along the loop conveyor 2*b*, the loop conveyor 2*b* is equipped with a plurality of crosspieces 2*b'''* each configured to intercept the layer "S" released by the dosing element 2*a* and to push it with a predetermined feed speed along the feed direction "A".

In use, the rows "F" of tissue products "P" coming from the dosing element 2*a* are released in a respective channel in such a way that the last products "P" of each row "F" are intercepted by a crosspiece 2*b'''* of the conveyor 2*b*. The tissue products "P" are thus pushed forward to the outfeed section of the loop conveyor 2*b* where the rows "F" forming the layer "S" of tissue products "P" are reciprocally moved towards each other.

Downstream of the management station 2, and more specifically, downstream of the loop conveyor 2*b*, the machine "M" comprises a packaging station 3 configured for receiving the layers "S" coming from the loop conveyor 2*b*. The packaging station 3 comprising a packaging unit 3*a* configured for wrapping a wrapper, such as, for example, a plastic film, around each layer "S" of tissue products "P".

In other words, the packaging unit 3*a* receives the layer "S" of tissue products "P" (or in some cases layers "S" of superposed tissue products "P" coming from the management station 2 and wraps a wrapper around it in such a way as to package it.

In a preferred embodiment (shown in the accompanying drawings), the packaging station 3 also comprises transfer means 2*c* (normally a lift plate positioned in the packaging station 3) configured for receiving and transferring each layer "S" coming from the loop conveyor 2*b* towards the packaging unit 3*a*.

The transfer means 2*c* are interposed between the loop conveyor 2*b* and the packaging unit 3*a* in such a way as to receive the layer "S" of tissue products "P" feeding out of the loop conveyor 2*b* and transfer it to the packaging unit 3*a* in which it will be packaged.

If the group of tissue products "P" comprises the presence of a single layer "S" of tissue products "P", the transfer means 2*c* receive the layer "S" coming from the loop conveyor 2*b* and transfer it directly to the packaging unit 3*a*.

On the other hand, if the group of tissue products "P" comprises the presence of a plurality of superposed layers "S", the transfer means 2*c* receive all the layers "S" necessary to form the group and only subsequently transfer the layers "S" to the packaging unit 3*a*.

In a preferred embodiment, to form a group of tissue products "P" having more than one layer "S", the transfer means 2*c* comprise a plurality of flat surfaces 2*c'* in which the loop conveyor 2*b* can release the layers "S". In this situation, the loop conveyor 2*b* tips in such a way that its outfeed section can be positioned at different heights corresponding to the heights of the various planes 2*c'* of the transfer means 2*c*.

In use, in order to release to the packaging unit 3*a* a group of tissue products "P" formed by several superposed layers "S", the loop conveyor 2*b* tips in such a way as to release a first layer "S" on a first surface 2*c'* of the transfer means 2*c*, a second layer "S" on a second surface 2*c'* which is raised relative to the first layer "S" and so on until occupying the desired number of surfaces 2*c'*. Once the desired number of layers "S" of tissue products "P" has been positioned, the transfer means 2*c* transfer the layers "S" to the packaging unit 3*a* in which they are wrapped.

In a further possible embodiment, not illustrated, in order to obtain a group of tissue products "P" having more than one layer "S", the transfer means 2*c* are equipped with a lifting surface and retaining means. More in detail, the lifting surface is movable along a vertical direction at least between a receiving position wherein the surface is at the same level as a surface 2*b''* of the loop conveyor 2*b* for receiving the layer "S" at the outfeed from the conveyor 2*b*, and a raised position wherein the lifting surface is positioned at a height higher than the surface 2*b''* of the loop conveyor 2*b*. In the raised position, the lifting surface transfers the layer "S" of tissue products "P" to the retaining means which retain it in such a way that the lifting surface can return to the receiving position for receiving a further layer "S" of tissue products "P". The movement of the lifting surface between the above-mentioned positions occurs until the retaining means contain the desired number of layers "S". The layers "S" stacked in this way are then transferred to the packaging unit 3*a* for being packaged.

In order to guarantee the conformity of the tissue products "P" forming the layers "S" of the group, the machine "M" also comprises at least one detection device 4 associated with the dosing element 2*a* and configured for detecting at least one filling parameter relative to a number and/or a dimension and/or an orientation of the tissue products "P" occupying the passageways 2*a'* and for generating a signal representing the at least one filling parameter.

Preferably, the detection device 4 is made in the form of a sensor or a smart-camera. Even more preferably, the machine "M" comprises a detection device 4 for each passageway 2*a'* of the dosing element 2*a* in such a way that it is possible to acquire for each row "F" of tissue products "P" at least one filling parameter making the control operations more precise. In this situation, the machine "M" comprises a plurality of sensors or smart-cameras.

The machine "M" also comprises a processing and control unit 5 configured to receive the representative signals acquired by the detection devices 4 and to process the signals in such a way as to compare them with signals relating to a reference layer "S" for deriving an acceptance condition, wherein the layer "S" in the dosing element 2*a* is consistent with the reference layer "S" and suitable for packaging in the packaging station 3, or a condition for eliminating the layer "S" if it is not suitable for packaging.

In use, therefore, once the passageways 2*a'* of the dosing element 2*a* have received a predetermined number of tissue products "P", the detection devices 4 acquire for each row "F" the filling parameters.

Preferably, the detection devices 4 acquire a parameter relative to the number of tissue products "P" present in each row "F" and a parameter relative to the length of each product "P" in such a way as to generate respective representative signals.

Subsequently, the dosing element 2*a* releases the layer "S" of tissue products "P" thus constituted which is pushed by the crosspieces 2*b*″ of the loop conveyor 2*b* to feed at the feed speed whilst the representative signals deriving from the acquisition of the detection devices 4 are processed by the processing and control unit 5 in such a way as to be compared with signals relating to a reference layer "S" previously selected as the desired layer "S".

If, for example, it is necessary to obtain layers "S" having four rows of three rolls of toilet paper each, the comparison must be made between the representative signals acquired and the signal relating to the size of the layer "S" and to this type of tissue product "P".

If the comparison provides a positive result, the layer "S" is suitable for being packaged to form the group of tissue products "P" and is therefore moved forward as described above between the various stations of the machine "M".

On the other hand, if the comparison provides a negative result the layer analysed must be eliminated and expelled from the machine "M".

The eliminating condition of layer "S" may be determined by one or more of the following reasons:

- at least one row "F" of the layer "S" has at least one tissue product "P" having an incorrect orientation, for example it has a vertical axis instead of horizontal, that is, it has an axis at right angles to the feed direction "A" of the products;
- at least one row "F" has a number of tissue products "P" different from the predetermined number, for example more or less than the desired number of a product "P";
- at least one row "F" of products has at least one tissue product "P" having incorrect dimensions, if, for example, a layer of rolls of toilet paper is to be obtained, the detection by the detection device 4 of one or more rolls having a length greater than or less than a reference length of the rolls of toilet paper is signalled as error and therefore as a reject. In this situation, it is also possible that if the "tail", that is to say, the end flap of the roll, is poorly glued to the body of the roll, the latter is signalled as non-conforming and therefore as an error.

Figure 3:
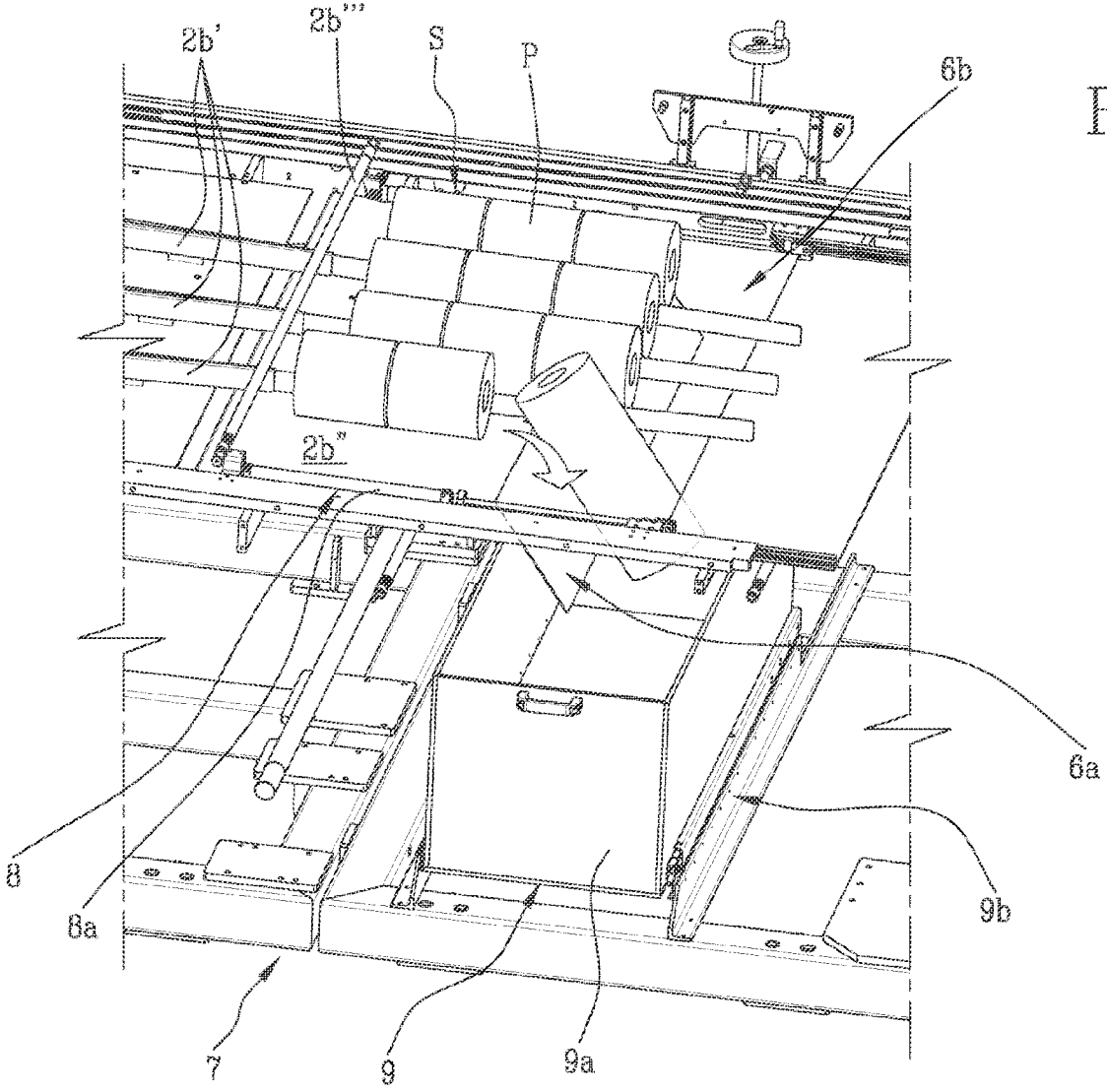
FIG. 3 shows an enlargement of a detail of the component of FIG. 2.

In other words, after the acquisition of the filling parameters relating to the layer "S" formed by the tissue products "P" occupying at a given instant the dosing element 2*a*, the processing and control unit 5 processes the signals deriving from these parameters in such a way as to derive the condition of acceptance wherein the layer "S" analysed is suitable and then proceeds forward to the packing station 3 (as in FIG. 2) or the condition of elimination wherein the layer "S" analysed has at least one anomaly amongst those listed and must be expelled from the machine "M" (as in FIG. 3 wherein in the layer "S" of rolls of toilet paper there is a roll of kitchen paper which is longer).

When the processing and control unit 5 derives the eliminating condition, the layer "S" containing the error is expelled from the machine "M" by the action of a rejection system 6 connected to the processing and control unit 5 and which can be activated to eject the layer "S". The ejection of the layer "S" occurs automatically without the need to actuate a stoppage of the machine "M". In effect, during the acquisition of the filling parameters, the detection devices 4 record data relating to the instant of time in which the acquisition occurs. In this way, the processing and control unit 5 is able, if the error condition of the layer "S" occurs, to derive the moment in which the layer "S" will pass, along the feed direction "A", close to the rejection system 6. By means of this information, the processing and control unit 5 can therefore activate the rejection system 6 at the appropriate moment, avoiding the elimination, together with the layer "S" to be rejected, also of the previous layer "S" (which continues towards the packaging station 3) or the layer after it (which is advancing on the loop conveyor 2*b* along the feed direction "A").

In this situation, therefore, the packaging station 3 will deal with the layer "S" (that is to say, continue the packaging step) before the eliminated layer and will wait for the layer "S" after the eliminated layer according to an operating mode in a coordinated fashion with the speed of the loop conveyor 2*b*.

In a possible embodiment, the operation for activating the rejection system 6 and therefore the elimination of the layer "S" containing an error occurs whilst all the layers "S" move forward in the machine "M" with a speed equal to the predetermined feed speed.

In a further possible embodiment, the operation for activating the rejection system 6 and therefore the elimination of the layer "S" containing an error occurs after the speed of feeding the layers "S" is slowed down relative to the predetermined feed speed.

Advantageously, the possibility of eliminating the incorrect layer "S" during its feeding along the feed direction "A" makes it possible to avoid lengthy and costly stoppages of the machine "M" due to the manual operations for removing the layer "S" of tissue products "P".

Advantageously, the connection between the processing and control unit 5 and the rejection system 6 allows a fast and precise elimination of the incorrect layer "S" to be performed, preventing the latter from creating blockages or malfunctions of the packaging station 3.

In the embodiment illustrated in the accompanying drawings, in particular in FIG. 3, the rejection system 6 is integrated with the surface 2*b*″ of the loop conveyor 2*b* and comprises a movable portion 6*a* inserted or insertable in a shaped seat 6*b* made on the surface 2*b*″ of the conveyor 2*b*.

The movable portion 6*a* can be moved between a fixed position, in which it is inserted in the shaped seat 6*b* to allow the sliding of the layers "S" on the loop conveyor 2*b*, and a spaced-apart position, in which it is in a distal position relative to the seat 6*b* to cause an expulsion by falling of the layer "S" of tissue products "P" considered to be in the eliminating condition from the processing and control unit 5.

In order to move the movable portion 6*a* between the fixed position and the spaced-apart position and vice versa, the machine "M" comprises movement means 8.

In the embodiment illustrated in the accompanying drawings, the movement means 8 comprise a pneumatic or electric actuator 8*a* and are configured for moving the movable portion 6*a* between the fixed position and the spaced-apart position and vice versa by means of a tilting rotation movement. In this situation, the movable portion 6*a* is made to rotate away from the surface 2*b*″ of the loop conveyor 2*b* in such a way as to create a sort of "slide" along which the layer "S" of incorrect tissue products "P" is made to slide for being expelled from the machine "M".

In a further possible embodiment, not illustrated, the movement means 8 are made in the form of a pneumatic or electric actuator configured for moving the movable portion 6*a* between the fixed position and the spaced-apart position and vice versa by a sliding motion along the surface 2*b*″ of the loop conveyor 2*b*. In this situation, the movable portion 6*a* is made to slide in the feed direction "A" in such a way as to leave the shaped seat 6*b* free and thus allow the falling through it of the layer "S" having an error.

Subsequently, the movable portion 6*a* is returned in the shaped seat 6*b* to allow the sliding on the surface 2*b*″ of the loop conveyor 2*b* of the layers "S" of tissue products "P" after the layer "S" expelled and considered by the processing and control unit 5 to be in the acceptance condition.

In use, therefore, the movable portion 6*a* remains inserted in the shaped seat 6*b* until the processing and control unit 5 activates the movement means 8 following detection of a layer "S" of products "P" having an anomaly. In this situation, the movement means 8 move the movable portion 6*a* from the fixed position to the spaced-apart position in such a way as to uncover the shaped seat 6*b* and allow the falling of the entire layer "S" of tissue products "P" indicated as incorrect (FIG. 3). Subsequently, the movement means 8 return the movable portion 6*a* to the fixed position in such a way as to allow the sliding along the feed direction "A" of the successive layers "S" considered to be in the acceptance condition.

Advantageously, the connection between the processing and control unit 5 and the rejection system 6 allows the machine "M" to be reliable and flexible since the rejection system 6 is only activated in precise moments of time and without the need to stop the entire machine "M".

According to another aspect of this invention, the machine "M" also comprises a base frame 7 to which the packaging station 3 is rigidly connected and on which the management station 2 is movable in a sliding fashion along the feed direction "A".

The management station 2 is movable between an operating position, wherein the management station 2 is close to the packaging station 3 to allow the transfer of each layer "S", and a non-operating position, wherein the management station 2 is spaced-apart from the packaging station 3 to prevent the transfer. In the preferred embodiment, the management station 2 is movable in a sliding fashion thanks to the action of a movement system (not illustrated) connected to the processing and control unit 5.

Advantageously, the movement of the control station 2 facilitates the operations for maintenance and cleaning of the machine "M". To perform these operations it is therefore possible to withdraw the management station 2 in such a way as to create an empty space between it and the packaging station 3 in which an operator can act.

The movement of the management station 2 may also be advantageously used for acting as rejection system 6 alternatively to the movable portion 6*a* described above. In this situation, following the identification by the detection devices 4 of a layer "S" in the eliminating condition, the processing and control unit 5 activates the movement system in such a way as to move the management station 2 away from the packaging station 3 to cause a falling of the layer "S" containing the error in the empty space created between the two stations 2, 3.

In other words, if after processing the signals deriving from the detection devices 4, the layer "S" of tissue products "P" is signalled as not consistent with a reference layer "S", the processing and control unit 5 moves the management station 2 in such a way that the layer "S" is released in the empty space present between the management station 2 and the packaging station 3. Subsequently, the processing and control unit 5 actuates the movement system again in such a way as to return the management station 2 to the operating position and allow the transfer of the successive layers "S" of tissue products "P" towards the packaging station 3.

Advantageously, the movement of the management station 2 allows an expulsion of the layer "S" considered unsuitable without the need to stop the entire machine "M" or the feeding of the layers "S".

As shown in the accompanying drawings, the machine "M" also comprises a collecting device 9 configured for receiving the tissue products "P" of the layer "S" expelled from the rejection system 6 and for moving the products "P" away from the machine "M".

In the embodiment illustrated in the accompanying drawings, the collecting device 9 is made in the form of a container 9*a* equipped with at least one sensor (not illustrated) configured for detecting a filling condition. In this embodiment, the container 9*a* is positioned below the mobile portion 6*a* in such a way as to receive the tissue products "P" of the layer "S" ejected through the shaped seat 6*b*.

In a further embodiment, the container 9*a* is positioned below a final portion of the loop conveyor 2*b* or, if present, the transfer means 2*c* in such a way as to receive the rejected tissue products "P" when the management station 2 is in a non-operating position, that is to say, away from the packaging station 3.

In use, once the sensor detects a filling condition, the container 9*a* is moved away from the machine "M" automatically or manually in such a way that it can be emptied. The incorrect and/or damaged tissue products "P" are eliminated whilst the others are re-inserted in the feed station 1.

Preferably, the container 9*a* is moved away from the machine "M" by a sliding movement along the guides 9*b* positioned in a direction transversal to the feed direction "A". After the operations for emptying the container 9*a*, it is re-inserted in the machine "M" again by a sliding movement along the guides 9*b*.

Alternatively, the collecting device 9 is made in the form of a conveyor belt preferably having a direction of sliding which is transversal to the feed direction "A". In this situation, the tissue products "P" forming the ejected layer "S" fall on the conveyor belt and are conveyed far from the machine "M" in such a way that they can be controlled. The damaged products "P" are eliminated whilst the others are re-inserted in the feed station 1.

The invention achieves the present aims overcoming the drawbacks of the prior art.

In particular, the machine "M" allows a control of the conformity of the layers "S" of tissue products "P" and their automatic expulsion if they are not suitable and without the need to perform any machine "M" shutdowns.

The rejection system 6 is mechanically simple and easy to maintain but at the same time is effective and reliable.

The control method is reliable, precise and able to increase the overall efficiency of the machine "M" and of the relative production process.

The control method and the expulsion operations are fully automated and do not therefore require the intervention of an operator.

The invention claimed is:

1. A machine for packaging groups of tissue products comprising:

a feed station comprising a feed mechanism comprising a first conveyor configured to transport a succession of products along a feed direction;

a management station positioned downstream of said feed station and comprising:

a dosing element including a plurality of passageways positioned side by side and extending parallel to said feed direction, each passageway being configured to receive a row of a predetermined number of products, the rows of said predetermined number of products positioned side by side in the dosing element defining a layer of a group of products;

a second conveyor including a plurality of pushing elements, each pushing element being configured to push one layer of the group of products at a time coming from the dosing element along said feed direction;

a packaging station positioned downstream of said management station and configured to receive each layer of the group of products coming from said second conveyor, said packaging station comprising a packaging unit configured to wrap a wrapper around a layer of the group of products;

at least one detection device configured to detect at least one filling parameter relative to a number and/or a dimension and/or an orientation of the products forming said layer of the group of products in the passageways of the dosing element, and generating a signal according to said at least one filling parameter;

a processing and control unit connected to said at least one detection device and configured to receive said signal and compare said signals with reference signal relating to a reference layer, to determine either an acceptance condition, when the layer of the group of products is consistent with the reference layer, or a rejection condition, when the layer of the group of products is not consistent with the reference layer;

a rejection system connected to said processing and control unit and configured to be activated to eject the layer of the group of products when the rejection condition has been determined;

wherein the rejection system is integrated with a surface of said second conveyor and comprises a movable portion inserted or insertable in a matching seat made on said surface, said movable portion being movable between a fixed position, wherein said movable portion is inserted in the matching seat to allow the sliding of said layers on the second conveyor, and a spaced-apart position, wherein said movable portion is in a distal position with respect to said matching seat to cause an expulsion by gravity of a layer in the eliminating condition.

2. The machine according to claim 1, also comprising a base frame to which is rigidly connected said packaging station and on which is movable in a sliding fashion said management station along the feed direction between an operating position, wherein said management station is close to said packaging station to allow the transfer of each layer, and a non-operating position, wherein said management station is away from said packaging station to prevent said transfer.

3. The machine according to claim 2, wherein said base frame comprises a movement system connected to said processing and control unit and which is activated in the rejection condition for moving said management station from the operating position to the non-operating position and cause an expulsion by gravity of said layer.

4. The machine according to claim 1, and further comprising a movement device configured for moving said movable portion from said fixed position to said spaced-apart position and vice versa by a sliding motion along said surface of the second conveyor, said movement device including a pneumatic or electrical actuator.

5. The machine according to claim 1, and further comprising a movement device configured for moving said movable portion from said spaced-apart position to said fixed position and vice versa by a tilting rotation movement, said movement device including a pneumatic or electrical actuator.

6. The machine according to claim 1, also comprising a collecting device configured for receiving the products of the layer ejected from said rejection system and for moving the ejected products away from the machine.

7. The machine according to claim 6, wherein said collecting device includes a conveyor belt having a direction of sliding transversal to said feed direction.

8. The machine according to claim 6, wherein said collecting device includes a container with at least one sensor configured to detect a filling condition, said container being moved away from said machine automatically or manually when a maximum filling condition is detected.

9. The machine according to claim 1, wherein each passageway includes a respective detection device configured for detecting the at least one filling parameter relative to a number and/or a dimension and/or an orientation of the products of a respective row.

10. A method for checking conformity of layers of groups of tissue products processed by a machine, comprising the steps of:

transporting a succession of tissue products along a feed direction;

feeding a dosing element including a plurality of passageways each configured for receiving a row formed by a predetermined number of tissue products, the tissue products which occupy said passageways defining a layer of tissue products;

acquiring by at least one detection device at least one filling parameter relative to a number and/or a dimension and/or an orientation of the tissue products of said layer in said plurality of passageways of the dosing element to generate a signal representing said at least one filling parameter;

releasing said layer of tissue products to the second conveyor which moves said layer along the feed direction at a predetermined feed speed;

comparing via a processing and control unit said signal with a reference signal of a reference layer to determine either a condition of acceptance if the layer of tissue products is consistent with the reference layer, and therefore suitable for packaging, or a condition of rejection if the layer of tissue products is not consistent with the reference layer;

activating a rejection system connected to said processing and control unit to eject the layer of tissue products advancing along the second conveyor if the rejection condition has been determined by said comparison step;

wherein in said acquisition step, the at least one detection device records an instant of time in which said acquisition occurs to determine a further instant of time in which to activate said rejection system to perform the ejection of the layer.

11. The method according to claim 10, wherein in said step of activating the rejecting system, a feeding speed of said layer of tissue products is less than said predetermined feed speed.

12. The method according to claim 10, wherein in said condition of rejection, a feeding speed of said layer of tissue products is equal to said predetermined feed speed.

13. The method according to claim 10, also comprising the steps of:

collecting in a collecting device the tissue products of the layer ejected from said rejection system;

moving said ejected tissue products away from the machine.

14. A machine for packaging groups of tissue products comprising:

a feed station comprising a feed mechanism comprising a first conveyor configured to transport a succession of products along a feed direction;

a management station positioned downstream of said feed station and comprising:

a dosing element including a plurality of passageways positioned side by side and extending parallel to said feed direction, each passageway being configured to receive a row of a predetermined number of products, the rows of said predetermined number of products positioned side by side in the dosing element defining a layer of a group of products;

a second conveyor including a plurality of pushing elements, each pushing element being configured to push one layer of the group of products at a time coming from the dosing element along said feed direction;

a packaging station positioned downstream of said management station and configured to receive each layer of the group of products coming from said second conveyor, said packaging station comprising a packaging unit configured to wrap a wrapper around a layer of the group of products;

at least one detection device configured to detect at least one filling parameter relative to a number and/or a dimension and/or an orientation of the products forming said layer of the group of products in the passageways of the dosing element, and generating a signal according to said at least one filling parameter;

a processing and control unit connected to said at least one detection device and configured to receive said signal and compare said signals with reference signal relating to a reference layer, to determine either an acceptance condition, when the layer of the group of products is consistent with the reference layer, or a rejection condition, when the layer of the group of products is not consistent with the reference layer;

a rejection system connected to said processing and control unit and configured to be activated to eject the layer of the group of products when the rejection condition has been determined;

a collecting device configured for receiving the products of the layer ejected from said rejection system and for moving the ejected products away from the machine;

wherein said collecting device includes a container with at least one sensor configured to detect a filling condition, said container being moved away from said machine automatically or manually when a maximum filling condition is detected.

* * * * *